US007340036B2

(12) United States Patent
Tomita et al.

(10) Patent No.: US 7,340,036 B2
(45) Date of Patent: Mar. 4, 2008

(54) X-RAY GENERATOR

(75) Inventors: Sadamu Tomita, Kyoto (JP); Tomomi Tamura, Kyoto (JP); Hidenobu Ishida, Kyoto (JP)

(73) Assignee: Shimadzu Corporation, Kyoto-Shi, Kyoto (JP)

( * ) Notice: Subject to any disclaimer, the term of this patent is extended or adjusted under 35 U.S.C. 154(b) by 0 days.

(21) Appl. No.: 11/812,852

(22) Filed: Jun. 22, 2007

(65) Prior Publication Data

US 2007/0258565 A1 Nov. 8, 2007

(51) Int. Cl.
*H01J 35/08* (2006.01)

(52) U.S. Cl. ..... 378/143; 378/137; 378/138; 378/139

(58) Field of Classification Search ..... 378/119, 378/121, 136, 137, 138, 139, 143
See application file for complete search history.

(56) References Cited

U.S. PATENT DOCUMENTS 5,563,923 A * 10/1996 Okada et al. ..... 378/138
6,381,305 B1 4/2002 Okada et al. ..... 378/137

FOREIGN PATENT DOCUMENTS

JP 2006-185842 7/2006

* cited by examiner

*Primary Examiner*—Courtney Thomas
(74) *Attorney, Agent, or Firm*—Manabu Kanesaka

(57) ABSTRACT

An X-ray generator includes an electron source generating an electron beam, a target generating an X-ray by a collision of the electron beam and extending in a direction orthogonal to the electron beam, and a cylindrical electrode covering a collision portion of the target to which the electron beam collides and having a bore allowing the electron beam to pass through. The electron source and the target are arranged in such a way that the X-ray is radiated in the direction orthogonal to an optical axis of the electron beam. A depression equivalent to a notch of the target is provided in a collision face side of the electron beam on the target and also in a reverse location of a tip of the target located on an outgoing radiation side of the X-ray relative to a collision location of the electron beam on the target.

5 Claims, 3 Drawing Sheets

Fig. 4
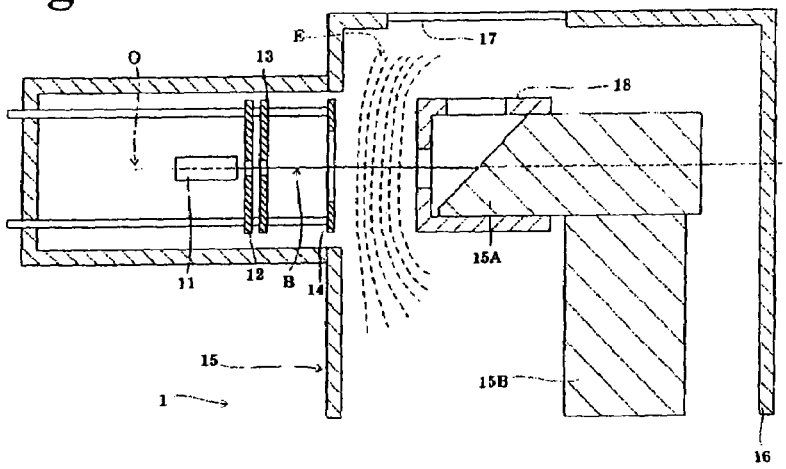
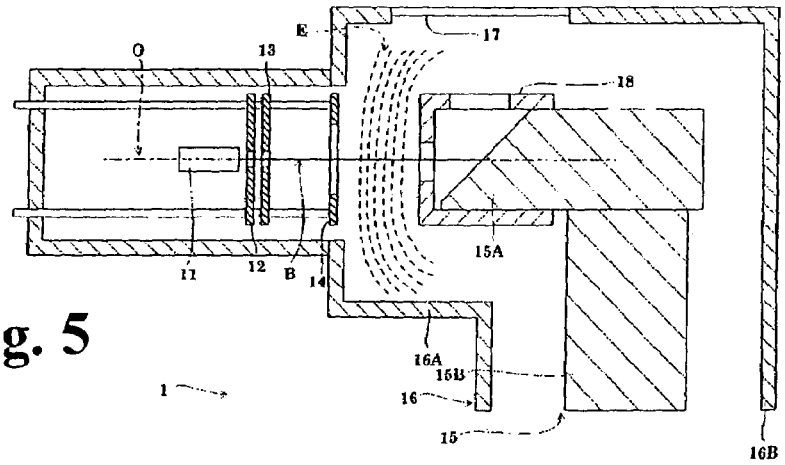
Fig. 5
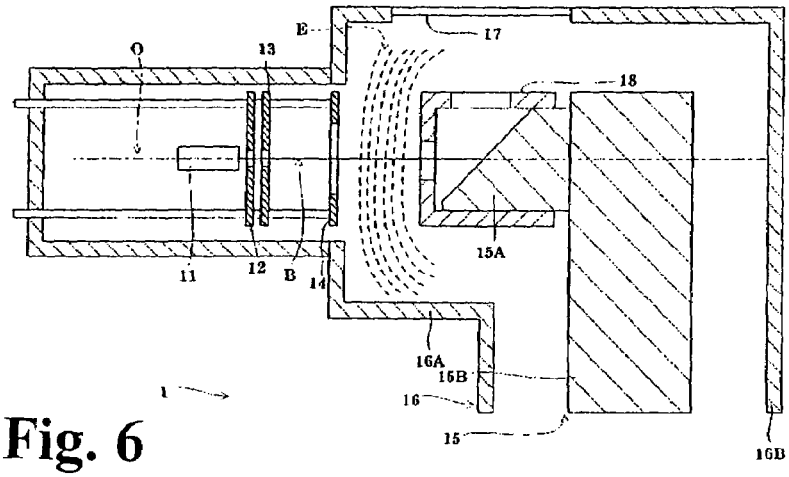
Fig. 6

X-RAY GENERATOR

BACKGROUND OF THE INVENTION AND RELATED ART STATEMENT

The present invention relates to an X-ray generator used in the industrial field, the medical field, etc., and especially, relates to the technique which controls the direction of an electron beam from an electron source arranged inside an X-ray generator.

In the X-ray generator (X-ray tube), an X-ray is generated by accelerating the electron beam generated from a cathode (electron source) which constitutes an electron gun, and by colliding with a target. In a first type of X-ray tube, as shown in FIG. 7, a cathode 102 and a target 106 are arranged in such a way that the outgoing radiation of the X-ray is carried out in parallel with an optical axis O of an electron beam B. FIG. 8 illustrates a second type wherein the cathode 102 and the target 106 are arranged such that the outgoing radiation of the X-ray is carried out in a direction orthogonal to the optical axis O of the electron beam B. The latter type will be explained in detail.

As shown in FIG. 8, an X-ray tube 101 includes the cathode 102 generating the electron beam B; two grids 103, 104 focusing the electron beam B; and a focusing lens 105 focusing the electron beam B. The electron gun consists of the above-mentioned cathode 102, grids 103, 104, and focusing lens 105. The X-ray tube 101 further includes a target 106 generating an X-ray by the collision of the electron beam B from the cathode 102, and an X-ray window 108 is arranged in a vacuum housing 107 which houses the electron gun and the target 106.

When suitable electric potential for the electron gun or the target 106 is applied and the electron beam B is generated from the cathode 102, the electron beam B proceeds in order of the grids 103, 104 and the focusing lens 105 inside the vacuum housing 107, and collides with the target 106. The X-ray is generated by the collision of this electron beam B. When this X-ray is generated, the outgoing radiation of the X-ray is carried out in a direction orthogonal to the optical axis O of the electron beam B, and this outgoing X-ray is taken out from the X-ray window 108. In the case of the former type shown in FIG. 7, the target 106 is arranged to face the cathode 102, and each is arranged in order of the cathode 102, grids 103, 104, focusing lens 105, and target 106, and the outgoing radiation of the X-ray is carried out in parallel with the optical axis O of the electron beam B.

Electric potential of, for example, approximately 100 kV is applied to the target 106. Also, in the case of the latter type shown in FIG. 8, in order to carry out the outgoing radiation of the X-ray in a direction orthogonal to the optical axis O of the electron beam B, the tip portion of the target 106 which is located on the outgoing radiation side of the X-ray is cut aslant. Therefore, an electric field E around the target 106 becomes unsymmetrical to the optical axis O of the electron beam B, and in fact, the electron beam B is bent. Due to the bending of this electron beam B, the electron beam B collides with the target 106 in a location further than the collision location of the ideal electron beam B relative to the X-ray window 108. When the distance between the collision location of the actual electron beam B and the X-ray window 108 (i.e., a generating source of the X-ray) becomes longer than the distance between the ideal generating source of the X-ray and the X-ray window 108, the distance between the generating source of the X-ray and a sample also becomes longer than the distance between the ideal generating source of the X-ray and the sample.

Because the distance between the generating source of the X-ray and the sample becomes longer, the magnifying power of the X-ray projection image of the sample declines. Also, because the electron beam B is bent, the ideal optical property of the focusing lens 105 cannot be obtained, so that the diameter of a focus of the electron beam B on the target 106 becomes large, hereby causing the resolution degradation.

In order to solve the above-mentioned problems, the tip of the target 106 is covered by a hood electrode (cylindrical electrode) so as to modify the asymmetry of the electric field E (for example, refer to the U.S. Pat. No. 5,077,771).

However, even if the tip of the target 106 is covered by the hood electrode, because the tip of the target 106 on the outgoing radiation side of the X-ray is cut off but another side of the outgoing radiation side of the X-ray relative to the optical axis of the electron beam is extended to the high voltage supply portion, the asymmetry of the electric field still remains. Consequently, reducing the asymmetry of the electric field further is required.

This invention is made in order to solve the above-mentioned problems, and a purpose of the invention is to provide an X-ray generator which can reduce the asymmetry of the electric field around the target.

Further objects and advantages of the invention will be apparent from the following description of the invention.

SUMMARY OF THE INVENTION

The solutions of the above-mentioned problems is based upon findings that because the symmetry and the asymmetry of an electric field around a target are based on the effect of each component part around an optical axis of an electron beam, the structure or configuration itself around the target is brought close to symmetry.

Since the tip portion of the target is cut off asymmetrically relative to an optical axis, the electric field is bent along the target which is cut aslant according to the outgoing radiation side of an X-ray. Therefore, if a depression which is equivalent to a notch of the target is provided relative to a collision location on another side of the tip of the target, which is the outgoing radiation side of the X-ray, the electric field is bent along the depression even to the reverse side of the outgoing radiation side, so that the electric field around the target can be brought close to symmetry.

Also, by bringing the structure or configuration itself around the target closer to symmetry, the structure or configuration acts on the electric field, further acting to bring the electric field around the target close to symmetry.

This invention based on the above-mentioned findings has the following structures.

That is, according to the invention of the first aspect, an X-ray generator includes an electron source that generates an electron beam; a target which generates an X-ray by the collision of the electron beam from the electron source and extends in a direction orthogonal to the electron beam; and a cylindrical electrode covering a collision portion of the target wherein the electron beam collides and also including a bore allowing the electron beam to pass through. The X-ray generator arranges the electron source and the target in such a way that the outgoing radiation of the X-ray is carried out in the direction orthogonal to the optical axis of the electron beam. The depression, which is equivalent to the notch of the target, is arranged on the collision face side of the electron beam on the target, and in the reverse location of the tip of the target that is located on the outgoing radiation side of the X-ray relative to the collision location of the electron beam on the target.

According to the invention in the second aspect, the X-ray generator described in the first aspect includes the depression whose notch starting location is located in such a way that the distance between the collision location and the notch starting location, and the distance between the tip of the target and the collision location, are approximately equal.

According to the invention in the first and second aspects, an asymmetry of the electric field around the target can be reduced as follows. Since the electron source and the target are arranged in such a way that the outgoing radiation of the X-ray is carried out in the direction orthogonal to the optical axis of the electron beam, the electric field around the target becomes unsymmetrical to the optical axis of the electron beam. Along with the tip of the target, which is located on the outgoing radiation side of the X-ray, the electric field is bent along the target in the reverse side of the collision face side relative to the collision location of the electron beam on the target.

Also provided is a cylindrical electrode covering the collision portion of the target wherein the electron beam collides, the electrode further comprising a bore allowing the electron beam to pass through. By providing the cylindrical electrode, the asymmetry of the electric field around the target can be modified. In addition, a depression, equivalent to the notch of the target, is provided in the collision face side, and also at the reverse location of the tip of the target that is located on the outgoing radiation side of the X-ray relative to the collision location of the electron beam on the target.

If the above-mentioned depression is provided, the electric field is also bent to the reverse side of the outgoing radiation side, and to the reverse side of the collision face side relative to the collision location along the depression (invention according to the first aspect). Moreover, by locating the notch starting location in such a way that the distance between the collision location and the notch starting location, and the distance between the tip of the target and the collision location are approximately equal, the electric field around the target can be brought close to symmetry, so that the asymmetry of the electric field around the target can be reduced (invention according to the second aspect). The disclosed "an optical axis of an electron beam" illustrates an imaginary progress of the electron beam that normally progresses to a straight line, and does not indicate the progress of an actual electron beam in consideration of bending.

According to the invention in a third aspect, the X-ray generator includes an electron source generating an electron beam; and a target generating an X-ray by the collision of the electron beam from the electron source. The X-ray generator arranges the electron source and the target in such a way that the outgoing radiation of the X-ray is carried out in a direction orthogonal to the optical axis of the electron beam. The target includes the collision portion extending in parallel with the optical axis of the electron beam and colliding with the electron beam. The target further includes a body portion intersecting perpendicularly and extending to the extending direction of the optical axis of the electron beam and the collision portion and extending to the reverse side to the outgoing radiation side of the X-ray relative to the collision location of the electron beam on the target.

According to the invention in the third aspect, an asymmetry of the electric field around the target can be reduced as follows. The electric field around the target becomes unsymmetrical to the optical axis of the electron beam based on the relation that arranges the electron source and the target in such a way that the outgoing radiation of the X-ray is carried out in a direction orthogonal to the optical axis of the electron beam. Along with the tip of the target, which is located on the outgoing radiation side of the X-ray, the electric field is bent along the target in the reverse side of the collision face side relative to the collision location of the electron beam on the target.

The collision portion of the target is configured in such a way as to extend in parallel with the optical axis of the electron beam and collide with the electron beam. Therefore, the collision portion has the structure of approaching the symmetry to the optical axis of the electron beam. Thus, by bringing the collision portion of the target close to symmetry, the collision portion of the target acts on the electric field, and brings the electric field around the target close to symmetry, thereby reducing the asymmetry of the electric field around the target.

Also, in the invention according to the third aspect, it is preferable to have a cylindrical electrode covering the collision portion of the target, and that the central axis of the cylindrical electrode be the same as the optical axis of the electron beam (invention according to the fourth aspect). By providing the cylindrical electrode to include the same central axis as the optical axis of the electron beam, that is, because the cylindrical electrode is symmetrical to the optical axis of the electron beam, the cylindrical electrode acts on the electric field further, and brings the electric field around the target close to symmetry further, thereby further reducing the asymmetry of the electric field around the target.

In addition, in the inventions (inventions according to the third and fourth aspects), it is preferable to have a housing that houses the electron beam and the electron source. Preferably, this housing extends in parallel with the optical axis of the electron beam; has the same central axis as the optical axis; and includes an optical-axis portion having rotational symmetry relative to the central axis and the body portion intersecting perpendicularly and extending to the extending direction of the optical axis of the electron beam and the optical-axis portion, and also extending in the reverse side of the outgoing radiation side of the X-ray relative to the collision location of the electron beam on the target (invention according to the fifth aspect). In other words, as in the case of the structure of the target, by providing the same optical-axis portion as the collision portion of the target for the housing, the optical-axis portion becomes symmetrical to the optical axis of the electron beam, and the optical-axis portion of the housing acts on the electric field further, bringing the electric field around the target closer to symmetry, thereby further reducing the asymmetry of the electric field around the target.

A X-ray image pickup apparatus is further disclosed, wherein:

(1) The X-ray image pickup apparatus includes an X-ray generating means generating and irradiating the X-ray and an X-ray detection means detecting the irradiated X-ray. The X-ray image pickup apparatus images an X-ray image based on the detected X-ray. The X-ray generating means includes the electron source generating the electron beam; the target generating the X-ray by the collision of the electron beam from the electron source; and the cylindrical electrode covering the collision portion of the target, wherein the electron beam collides, and also includes the bore allowing the electron beam to pass through.

The electron source and the target are arranged in such a way that the outgoing radiation of the X-ray is carried out in the direction orthogonal to the optical axis of the electron beam. The X-ray image pickup apparatus also has a depression which is equivalent to the notch of the target located in the collision face side of the electron beam on the target, and also located in the reverse location of the tip of the target, which is located on the outgoing radiation side of the X-ray relative to the collision location of the electron beam on the target.

According to (1) above, the invention includes the cylindrical electrode along with the depression, which is equivalent to the notch of the target and is provided in the collision face side of the electron beam on the target and in the reverse location of the tip of the target located in the outgoing radiation side of the X-ray relative to the collision location of the electron beam on the target. As a result, the electric field around the target can be brought close to symmetry, thereby reducing the asymmetry of the electric field around the target. By reducing the asymmetry of the electric field, the decline of the magnifying power of the X-ray image and resolution degradation can be prevented. Preferably, the notch starting location is located in such a way that the distance, between the collision location and the notch starting location, and the distance between the tip of the target and the collision location are approximately equal. As a result, the electric field around the target can be brought closer to symmetry, thereby reducing the asymmetry of the electric field around the target further.

(2) The X-ray image pickup apparatus includes: an X-ray generating means generating and irradiating the X-ray; and an X-ray detection means for detecting the irradiated X-ray and for imaging the X-ray image based on the detected X-ray. The X-ray generating means includes the electron source that generates the electron beam; and the target that generates the X-ray by the collision of the electron beam from the electron source. The electron source and the target are arranged in such a way that the outgoing radiation of the X-ray is carried out in a direction orthogonal to the optical axis of the electron beam. The target includes the collision portion extending in parallel with the optical axis of the electron beam, and colliding with the electron beam; and the body portion intersecting perpendicularly and extending to the extending direction of the optical axis of the electron beam and the collision portion, and also extending to the reverse side of the outgoing radiation side of the X-ray relative to the collision location of the electron beam on the target.

According to the invention described in the above (2); the target includes a collision portion extending in parallel with the optical axis of the electron beam that collides with the electron beam, Also included is a body portion intersecting perpendicularly and extending to the extending direction of the optical axis of the electron beam and the collision portion, that also extends to the reverse side of the outgoing radiation side of the X-ray relative to the collision location of the electron beam on the target. As a result, the electric field around the target can be brought closer to symmetry, thereby reducing the asymmetry of the electric field around the target. By reducing the asymmetry of the electric field, decline of the magnifying power of the X-ray image and the resolution degradation can be prevented.

According to the X-ray generator of the invention, the cylindrical electrode is included, and the depression which is equivalent to the notch of the target is provided in the collision face side of the electron beam on the target and in the reverse location of the tip of the target located in the outgoing radiation side of the X-ray relative to the collision location of the electron beam on the target (invention described in the first aspect). Alternatively, the target includes the collision portion extending in parallel with the optical axis of the electron beam, and collides with the electron beam. Also included is a body portion that intersects perpendicularly and extends to the extending direction of the optical axis of the electron beam and the collision portion and also extends to the reverse side of the outgoing radiation side of the X-ray relative to the collision location of the electron beam on the target (invention described in the third aspect). As a result, the electric field around the target can be brought closer to symmetry, thereby reducing the asymmetry of the electric field around the target.

BRIEF DESCRIPTION OF THE DRAWINGS

FIG. 4 is a schematic sectional view of the X-ray tube in which the vicinity of the tip of the target on the outgoing radiation side of the X-ray is enlarged;

FIG. 5 is a schematic sectional view of the X-ray tube in which the vicinity of the tip of the target according to a modified example is enlarged;

FIG. 6 is a schematic sectional view of the X-ray tube in which the vicinity of the tip of the target according to a further modified example is enlarged;

DETAILED DESCRIPTION OF PREFERRED EMBODIMENTS

Embodiment 1

Hereunder, an embodiment 1 of the invention will be explained with reference to the attached drawings.

Figure 1:
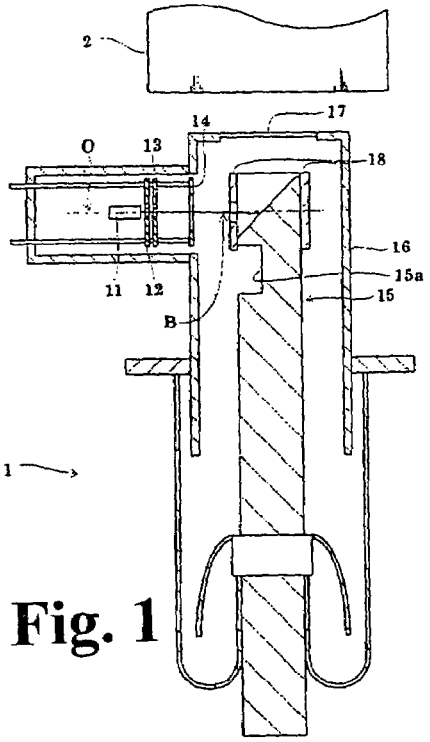
FIG. 1 is a schematic sectional view showing the structure of an X-ray tube according to an embodiment 1.
Figure 2:
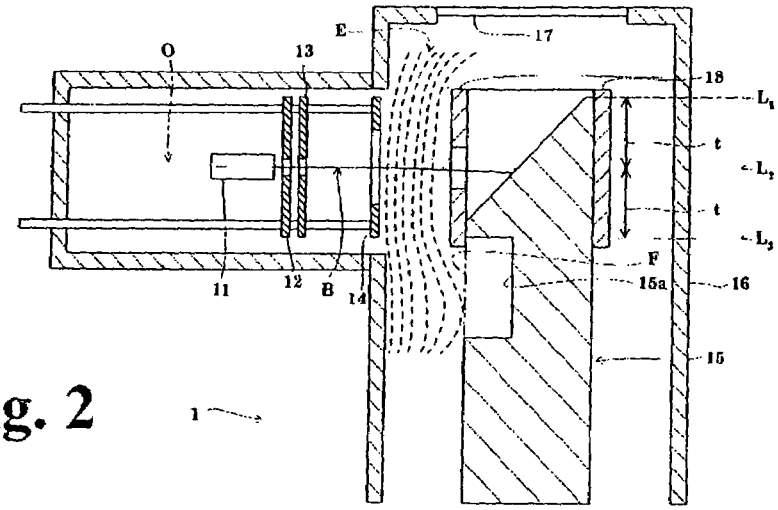
FIG. 2 is a schematic sectional view of the X-ray tube in which the vicinity of the tip of a target on the outgoing radiation side of an X-ray is enlarged.

FIG. 1 is a schematic sectional view showing the structure of an X-ray tube according to the embodiment 1, and FIG. 2 is a schematic sectional view of the X-ray tube in which the vicinity of the tip of the target on the outgoing radiation side of an X-ray is enlarged.

The X-ray tube 1 shown in FIG. 1 is used for an X-ray image pickup apparatus as represented by an X-ray nondestructive inspection equipment and the like. The X-ray image pickup apparatus includes the X-ray tube 1 and an X-ray detector 2 which detects the X-ray irradiated from the X-ray tube 1. The X-ray detector 2 has, for example, an image intensifier I.I), or a flat-panel type X-ray detector (FPD), etc. The X-ray detector 2 detects the X-ray irradiated from the X-ray tube 1, and based on this detected X-ray, an X-ray image is imaged. The X-ray tube 1 is equivalent to the X-ray generator in this invention, and also equivalent to an X-ray generating means in this invention. Also, the X-ray detector 2 is equivalent to an X-ray detection means in this invention.

The X-ray tube 1 includes a cathode 11 generating an electron beam B, two grids 12, 13 narrowing down the electron beam B, a focusing lens 14 focusing the electron beam B, and a target 15 generating an X-ray by the collision of the electron beam B from the cathode 11. In the embodiment 1, including the embodiment 2 described later, an impregnation type cathode, which is generally used in the Braun tube and the like, is used as the cathode 11. This cathode is long lasting as compared to a filament formed by tungsten. The cathode 11 is equivalent to an electron source in this invention, and the target 15 is equivalent to the target in this invention.

The focusing lens 14 has a hole at the core, and an electrostatic lens is constituted near the hole by the electric potential applied to the focusing lens 14 and the target 15. The focusing lens 14 focuses the electron beam B as in the case of the focusing lens of optics.

The target 15 has the shape of a long and slender cylinder, and the cathode 11 and the target 15 are arranged by a positional relationship shown in FIGS. 1, 2, in such a way that the outgoing radiation of the X-ray is carried out in a direction orthogonal to an optical axis (see a dashed-dotted line in FIGS. 1, 2) O of the electron beam B. More specifically, while the tip $L_1$ (see FIG. 2) of the target 15 is located in the outgoing radiation side of the X-ray, the cylindrical target 15 is arranged in such a way as to extend in the reverse side of the outgoing radiation side of the X-ray relative to a collision location $L_2$ (see FIG. 2) of the electron beam B on the target 15. Also, the tip portion of the target 15, which is located on the outgoing radiation side of the X-ray, is cut aslant. The cathode 11 and the target 15 are arranged as mentioned above, and by cutting the tip portion of the target 15 aslant, the electron beam B from the cathode 11 collides in the collision location $L_2$ on the target 15 which is cut aslant, so that the outgoing radiation of the X-ray is carried out from a direction of 90 degrees.

An electron gun consists of the cathode 11, the grids 12, 13, and the focusing lens 14 described above. The electron gun and the target 15 are housed in a vacuum housing 16. An X-ray window 17 is arranged in the vacuum housing 16 on the outgoing radiation side of the X-ray.

Suitable electric potential for the electron gun or the target 15 is applied. An electric potential of, for example, approximately 100 kV is applied to the target 15. When the electron beam B is generated from the cathode 11 where the electric potential is applied, the electron beam B proceeds in order of the grids 12, 13 and the focusing lens 14 inside the vacuum housing 16, and collides with the target 15. An X-ray is generated by the collision of this electron beam B. When the X-ray is generated, the outgoing radiation of the X-ray is carried out in a direction orthogonal to the optical axis O of the electron beam B, and the radiated X-ray is taken out from the X-ray window 17. The optical axis O of the electron beam B in this specification is not the progress of an actual electron beam B in consideration of the bending described later, and represents an imaginary progress (straight line which connects the cathode 11 and the ideal collision location $L_2$) of the electron beam B which normally progresses to the straight line.

Figure 8:
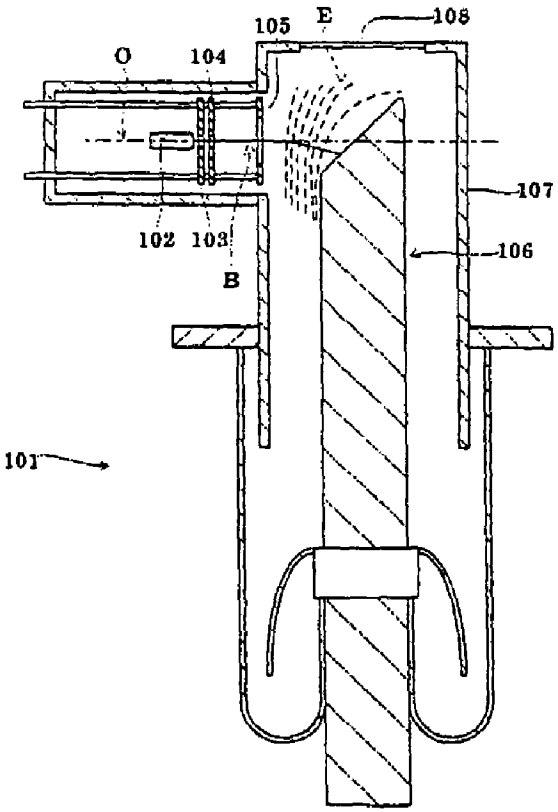
Fig. 8 Prior Art
FIG. 8 is a schematic sectional view showing the structure of another type of conventional X-ray tube which differs from that in FIG. 7.
Figure 7:
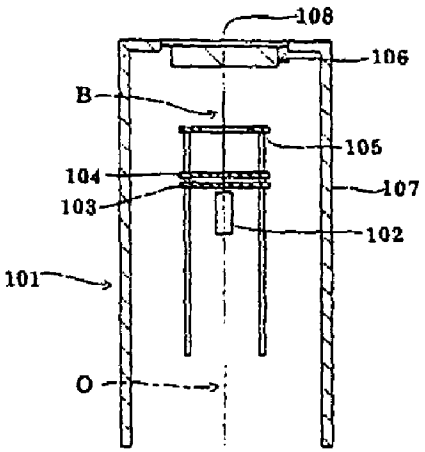
Fig. 7 Prior Art
FIG. 7 is a schematic sectional view showing the structure of a conventional X-ray tube.

Due to the relationship wherein the cathode 11 and the target 15 are arranged in such a way that the outgoing radiation of the X-ray is carried out in a direction orthogonal to the optical axis O of the electron beam B, an electric field E around the target 15 becomes unsymmetrical to the optical axis O of the electron beam B (see FIG. 8). More specifically, since the high electric potential of approximately 100 kV described above is applied to the target 15, and the tip portion of the target 15 is cut in a slant direction, the electric field E around the target 15 becomes unsymmetrical to the optical axis O of the electron beam B.

Along with the tip of the target 15 that is located on the outgoing radiation side of the X-ray, the electric field E is bent along the target 15 in the reverse side of a collision face F side relative to the collision location $L_2$ of the electron beam B on the target 15 (see FIG. 2). In the embodiment 1, since the tip portion of the target 15 is cut aslant, the electric field E is bent along the target 15 that is cut aslant along with the outgoing radiation side of the X-ray (see FIG. 2). Due to the bending of this electron beam B, the electron beam B collides with the target 15 in a distant location relative to the X-ray window 17 further than the collision location $L_2$ of the ideal electron beam B (see FIG. 2).

Consequently, the embodiment 1 includes a cylindrical hood electrode 18, and the cylindrical hood electrode 18 covers the tip portion of the target 15. The asymmetry of the electric field E (see FIG. 2) is modified by providing this hood electrode 18.

Furthermore, a depression 15*a* equivalent to a notch of the target 15 is arranged on the collision face F side. If the notch starting location is set at $L_3$ as shown in FIG. 2, the notch starting location $L_3$ is located in the reverse side of the tip $L_1$ of the target 15 relative to the collision location $L_2$. If this depression 15*a* is arranged, as shown in FIG. 2, the electric field E is bent to the reverse side of the collision face side F relative to the collision location $L_2$ along the depression 15*a*, and also bent to the reverse side of the outgoing radiation side.

Furthermore, the notch starting location $L_3$ described above is located in such a way that the distance between the collision location $L_2$ and the notch starting location $L_3$, and the distance between the tip $L_1$ of the target 15 located on the outgoing radiation side of the X-ray and the collision location $L_2$, becomes approximately equal (see a distance t in FIG. 2). By locating the notch starting location $L_3$ as described above, the electric field E around the target 15 can be brought close to symmetry, thereby reducing the asymmetry of the electric field E around the target 15.

Also, according to the X-ray image pickup apparatus with the X-ray tube 1, by reducing the asymmetry of the electric field E around the target 15, decline of the magnifying power of the X-ray image and the resolution degradation can be prevented.

Next, the embodiment 2 of the invention will be explained with reference to the attached drawings.

Figure 3:
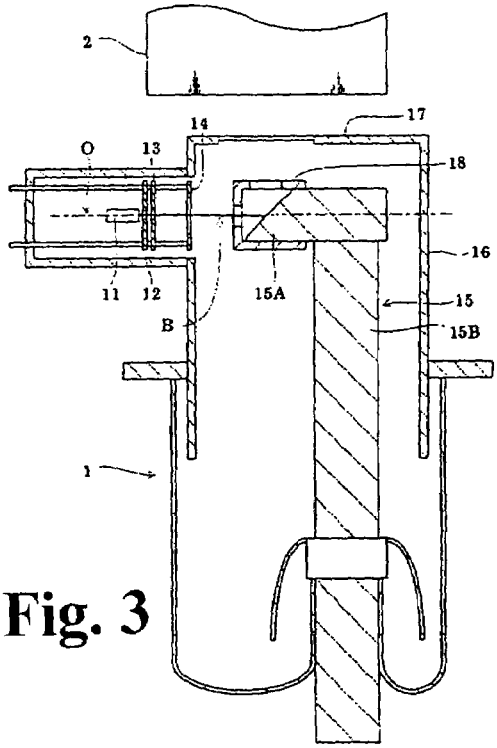
FIG. 3 is a schematic sectional view showing the structure of the X-ray tube according to an embodiment 2.

FIG. 3 is a schematic sectional view showing the structure of the X-ray tube according to the embodiment 2, and FIG. 4 is a schematic sectional view of the X-ray tube in which the vicinity of the tip of the target which is located on the outgoing radiation side of the X-ray is enlarged. Also, the same symbols are assigned to the corresponding parts in the embodiment 1, and their explanations are omitted.

The X-ray tube 1 according to the embodiment 2 includes the cathode 11, two grids 12, 13, focusing lens 14, target 15, and hood electrode 18 as in the case of the embodiment 1, and are housed in the vacuum housing 16 in which the X-ray window 17 is arranged on the outgoing radiation side of the X-ray. The difference between the embodiment 1 and the embodiment 2 is that the structure of the target 15 and the arranged direction of the hood electrode 18 are different.

More specifically, in the embodiment 2, the target 15 includes: a collision portion 15A extending in parallel with the optical axis O of the electron beam B and colliding with the electron beam B; and a body portion 15B intersecting perpendicularly and extending relative to the extending direction of the optical axis O of the electron beam B and the collision portion 15A, and also extending to the reverse side of the outgoing radiation side of the X-ray relative to the collision location of the electron beam on the target 15. Because the vacuum housing 16 also houses the collision portion 15A of the target 15, the size of the vacuum housing 16 in the embodiment 2 becomes larger than that in the embodiment 1. The collision portion 15A corresponds to the collision portion in the claims, and the body portion 15B is equivalent to the body portion in the claims.

Also, the central axis of the hood electrode 18 is the same as the optical axis O of the electron beam B. The hood electrode 18 in the embodiment 2 corresponds to the cylindrical electrode in the claims.

According to the X-ray tube 1 arranged as described above, the collision portion 15A of the target 15 is arranged in such a way as to extend in parallel with the optical axis O of the electron beam B and collide with the electron beam B. Therefore, the collision portion 15A becomes the structure of approaching the symmetry to the optical axis O of the electron beam B. Thus, by bringing the collision portion 15A of the target 15 close to symmetry, the collision portion 15A of the target 15 can act on the electric field E (see FIG. 4), so that the electric field E around the target 15 can be brought close to symmetry, hereby reducing the asymmetry of the electric field E around the target 15. Moreover, the decline of the magnifying power of the X-ray image and the resolution degradation can be prevented by reducing the asymmetry of the electric field E around the target 15.

Also, since the hood electrode 18, which has the same central axis as the optical axis O of the electron beam B because the hood electrode 18 is symmetrical to the optical axis O of the electron beam B, the hood electrode 18 can act on the electric field E further, and the electric field E around the target 15 can be brought closer to symmetry, thereby reducing the asymmetry of the electric field E around the target 15 further.

This invention is not limited to the above-mentioned embodiments, and can be modified as follows.

(1) In each embodiment, an industrial appliance such as a nondestructive inspection equipment was explained as an example of the X-ray image pickup apparatus. However, this invention can also be applied to a medical apparatus such as an X-ray diagnostic apparatus.

(2) In each embodiment, the impregnation type cathode is used as the electron source. However, any other cathodes other than this may be used.

(3) The embodiments 1 and 2 may be combined together.

(4) In each embodiment, although the hood electrode 18 is provided to modify the asymmetry of the electric field E, the hood electrode 18 does not necessarily have to be provided.

(5) In the embodiment 1, the size of the depression 15*a*, other than the notch starting location $L_3$ (notch depth of the depression 15*a*, and the length of the depression 15*a*), is not limited. What is necessary is just to suitably change the size of the depression 15*a* so that the electric field E approaches the symmetry relative to the optical axis O of the electron beam B, since distribution of the electric field E changes serially by the amount of the electrical potential applied to the target 15, or the electron beam B, etc.

(6). In the embodiment 2, although the magnitude of the vacuum housing 16 is larger than that of the embodiment 1, the shape of the vacuum housing 16 is the same as that of the embodiment 1. On the other hand, as shown in FIG. 5, the vacuum housing 16 extends in parallel with the optical axis O of the electron beam B, and includes the same central axis as the optical axis O. The vacuum housing 16 may also include an optical-axis portion 16A that provides symmetry of revolution relative to the central axis and a body portion 16B that intersects perpendicularly and extends relative to the extending direction of the optical axis O of the electron beam B and the optical-axis portion 16A, and also extends to the reverse side of the outgoing radiation side of the X-ray relative to the collision location of the electron beam B on the target 15.

More specifically, as in the case of the structure of the target 15 of the embodiment 2, the vacuum housing 16 also includes the optical-axis portion 16A, which is the same as the collision portion 15A of the target 15, so that the optical-axis portion 16A becomes symmetrical to the optical axis O of the electron beam B, and the optical-axis portion 16A of the vacuum housing 16 acts further on the electric field E, so that the electric field E around the target 15 can be brought closer to symmetry, thereby reducing the asymmetry of the electric field E around the target 15 further. In a modified example (6), the vacuum housing 16 is equivalent to the housing in this embodiment; the optical-axis portion 16A is equivalent to the optical-axis portion in this embodiment; and the body portion 16B is equivalent to the body portion in this embodiment.

(7) In the embodiment 2, the collision portion 15A of the target 15 and the body portion 15B are arranged in the positional relationship shown in FIGS. 3, 4. However the positional relationship may be arranged as shown in FIG. 6. Also, the collision portion 15A may be formed by making the collision portion 15A and the body portion 15B one piece, and inflecting the body portion 15B 90 degrees. Incidentally, the configuration of the vacuum housing 16 may be the configuration of the embodiment 2 shown in FIGS. 3, 4, or the configuration of the modified example shown in FIG. 6.

The disclosure of Japanese Patent Application No. 2004-380608, filed on Dec. 28, 2004, is incorporated as a reference in the application.

While the invention has been explained with reference to the specific embodiments of the invention, the explanation is illustrative and the invention is limited only by the appended claims.

What is claimed is:

1. An X-ray generator comprising:

an electron source generating an electron beam, a target generating an X-ray by a collision of the electron beam, the target extending in a direction orthogonal to an optical axis of the electron beam, and a cylindrical electrode covering a collision portion of the target to which the electron beam collides, and having a bore allowing the electron beam to pass through, wherein the electron source and the target are arranged in such a way that the X-ray is radiated in the direction orthogonal to the optical axis of the electron beam, and a depression as a notch of the target is provided in a collision face side of the electron beam on the target and also in a reverse location of a tip of the target located on an outgoing radiation side of the X-ray relative to a collision location of the electron beam on the target.

2. An X-ray generator according to claim 1, wherein a notch starting location is arranged in such a way that a distance between the collision location and the notch starting location, and a distance between the tip of the target and the collision location are approximately equal.

3. An X-ray generator comprising:

an electron source generating an electron beam, and a target generating an X-ray by a collision of the electron beam from the electron source, the electron source and the target being arranged in such a way that the X-ray is radiated in a direction orthogonal to an optical axis of the electron beam, wherein the target comprises:

a collision portion extending in parallel with the optical axis of the electron beam, and colliding with the electron beam, and a body portion intersecting perpendicularly to an extending direction of the optical axis of the electron beam and an extending direction of the collision portion, the body portion also extending to a reverse side of an outgoing radiation side of the X-ray relative to a collision location of the electron beam on the target.

4. An X-ray generator according to claim 3, further comprising a cylindrical electrode covering the collision portion of the target, said cylindrical electrode having a central axis same as the optical axis of the electron beam.

5. An X-ray generator according to claim 3, further comprising a housing retaining the electron beam and the electron source, the housing including an optical-axis portion extending in parallel with the optical axis of the electron beam, and a central axis same as the optical axis, the central axis being rotational symmetry relative to the optical-axis.

* * * * *